US010252553B2

(12) United States Patent
Takabatake

(10) Patent No.: US 10,252,553 B2
(45) Date of Patent: Apr. 9, 2019

(54) PRINTER

(71) Applicant: FUJITSU COMPONENT LIMITED, Tokyo (JP)

(72) Inventor: Yoshinari Takabatake, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/834,377

(22) Filed: Dec. 7, 2017

(65) Prior Publication Data

US 2018/0229521 A1 Aug. 16, 2018

(30) Foreign Application Priority Data

Feb. 10, 2017 (JP) ..... 2017-023263

(51) Int. Cl.
*B41J 3/36* (2006.01)
*B41J 29/02* (2006.01)
*B41J 29/13* (2006.01)

(52) U.S. Cl.
CPC ..... *B41J 29/02* (2013.01); *B41J 3/36* (2013.01); *B41J 29/023* (2013.01); *B41J 29/13* (2013.01)

(58) Field of Classification Search
CPC . B41J 29/02; B41J 29/023; B41J 29/13; B41J 3/36
USPC ..... 347/110
See application file for complete search history.

(56) References Cited

U.S. PATENT DOCUMENTS

| | | | | |
|---|---|---|---|---|
| 6,118,469 | A | 9/2000 | Hosomi | |
| 2002/0063374 | A1* | 5/2002 | Takahashi | B65H 1/04 271/10.01 |
| 2013/0255459 | A1 | 10/2013 | Nakajima et al. | |
| 2013/0314721 | A1 | 11/2013 | Colonel et al. | |
| 2014/0085395 | A1 | 3/2014 | Takahashi et al. | |
| 2015/0030889 | A1 | 1/2015 | Kamaguchi | |

FOREIGN PATENT DOCUMENTS

| | | |
|---|---|---|
| JP | 2009-190413 | 8/2009 |
| KR | 10-2002-0069541 | 9/2002 |

OTHER PUBLICATIONS

European Search Report in Application No. 17206540.1, dated Jun. 13, 2018.

(Continued)

*Primary Examiner* — Huan H Tran
*Assistant Examiner* — Alexander D Shenderov
(74) *Attorney, Agent, or Firm* — Staas & Halsey LLP

(57) ABSTRACT

A printer including: a housing; a rotating member that is rotatably fixed to the housing; a fixing part that is formed on the housing, and rotatably supports a rotary shaft of the rotating member; wherein one of the fixing part and the rotating member includes a projection formed around the rotary shaft and capable of contacting the other of the fixing part and the rotating member, the other of the fixing part and the rotating member includes a recess that is formed around the rotary shaft and does not contact the projection, a flat part that is formed around the rotary shaft and allows the rotation of the rotating member while contacting the projection, and a regulating part that is formed around the rotary shaft, contacts the projection and regulates the rotation of the rotating member.

6 Claims, 8 Drawing Sheets

(56) References Cited

OTHER PUBLICATIONS

Japanese Platform for Patent Information English abstract for Japanese Patent Publication No. 2009-190413, published Aug. 27, 2009.
Korean Intellectual Property Office English abstract for Korean Patent Publication No. 10-2002-0069541, published Sep. 5, 2002.
Korean Office Action dated Jan. 22, 2019 in corresponding Korean Patent Application No. 10-2018-0001091.

* cited by examiner

PRINTER

CROSS-REFERENCE TO RELATED APPLICATION

This application is based upon and claims the benefit of priority of the prior Japanese Patent Application No. 2017-023263 filed on Feb. 10, 2017, the entire contents of which are incorporated herein by reference.

FIELD

A certain aspect of the embodiments is related to a printer.

BACKGROUND

FIG. 1A is a perspective view of a printer. FIG. 1B is a schematic configuration diagram of a battery storing part. FIG. 1C is a configuration diagram of a battery lock.

A printer 1 of FIG. 1 is a mobile printer, and includes a housing 2, an upper cover 3, a battery cover 4, a storing part 5 and a battery lock 6. The battery cover 4 is rotatably fixed to a side surface of the housing 2. The storing part 5 is a space in which the battery 7 is stored. The battery lock 6 includes a taper 6*a* as illustrated in FIG. 1C. The battery lock 6 is fixed to one end of a spring 8, and the other end of the spring 8 is fixed to a back surface of the upper cover 3. The spring 8 biases the battery lock 6 downward in FIG. 1B. Thereby, the taper 6*a* protrudes toward the storing part 5.

When a battery 7 is inserted into the storing part 5, a user pushes the battery 7 toward the storing part 5. At this time, the battery 7 contacts the taper 6*a* and the battery lock 6 moves upward in FIG. 1B, and therefore the battery 7 can be inserted into the storing part 5. When the battery 7 is completely inserted into the storing part 5, the battery lock 6 is biased by the spring 8 and the taper 6*a* protrudes toward the storing part 5. Thereby, the battery 7 is held in the storing part 5, which makes it possible to prevent the battery 7 from falling out of the housing.

FIG. 2A is a perspective view of another printer. FIG. 2B is a perspective view of the another printer in a state of removing the battery cover. FIG. 2C is a perspective view of the another printer of FIG. 2B in an overturned state. The another printer of FIGS. 2A to 2C is described in Patent Document 1 (Japanese Laid-open Patent Publication No. 2009-190413).

A printer 11 of FIG. 2A includes a housing 12, an operation part 13 and a battery cover 14. When the battery cover 14 is removed, a storing part 15 is exposed as illustrated in FIG. 2B. A through-hole 16 is formed on a bottom surface of the housing 12.

Moreover, the printer 11 includes a holding member 18 illustrated in FIG. 2C. The holding member 18 is attached to the bottom surface of the housing 12, and can be removed from the bottom surface of the housing 12 in an A direction illustrated in FIG. 2C. A projection 17 having a substantially trapezoidal shape illustrated in FIG. 2B is formed on the holding member 18. When the holding member 18 is attached to the bottom surface of the housing 12, the projection 17 is inserted into the through-hole 16 and appears in the storing part 15 as illustrated in FIG. 2B, it is possible to prevent the battery 10 from falling out of the housing 12.

SUMMARY

According to an aspect of the present invention, there is provided a printer including: a housing; a rotating member that is rotatably fixed to the housing; a fixing part that is formed on the housing, and rotatably supports a rotary shaft of the rotating member; wherein one of the fixing part and the rotating member includes a projection formed around the rotary shaft and capable of contacting the other of the fixing part and the rotating member, and the other of the fixing part and the rotating member includes a recess that is formed around the rotary shaft and does not contact the projection, a flat part that is formed around the rotary shaft and allows the rotation of the rotating member while contacting the projection, and a regulating part that is formed around the rotary shaft, contacts the projection and regulates the rotation of the rotating member.

The object and advantages of the invention will be realized and attained by the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Figure 1A:
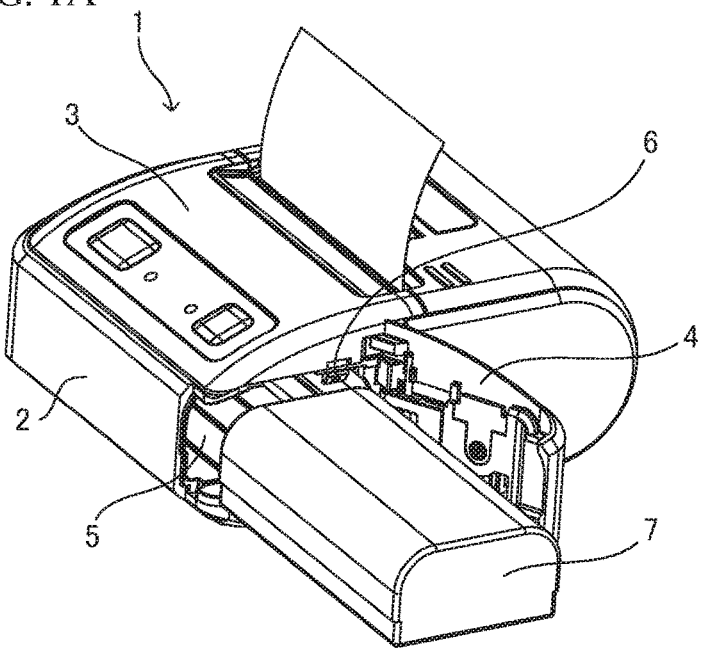
FIG. 1A is a perspective view of a printer.
Figure 1B:
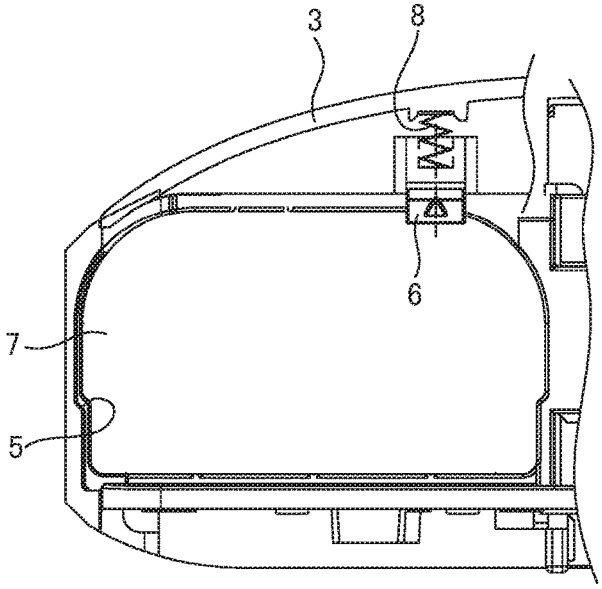
FIG. 1B is a schematic configuration diagram of a battery storing part.
Figure 1C:
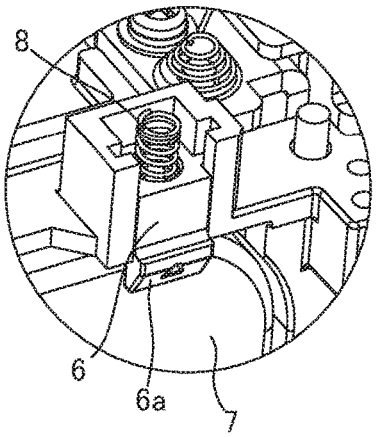
FIG. 1C is a configuration diagram of a battery lock.
Figure 2A:
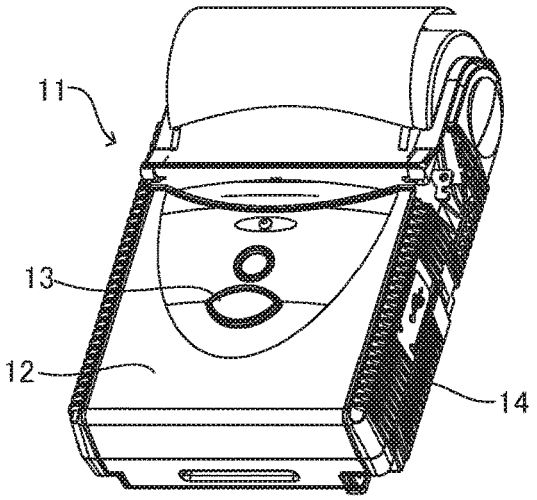
FIG. 2A is a perspective view of another printer.
Figure 2B:
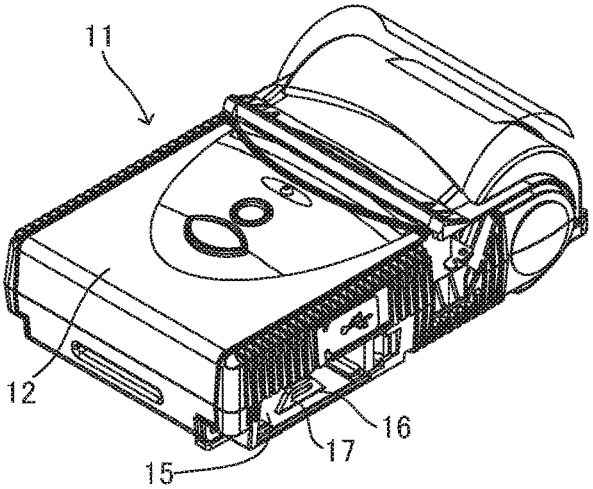
FIG. 2B is a perspective view of the another printer in a state of removing the battery cover.
Figure 2C:
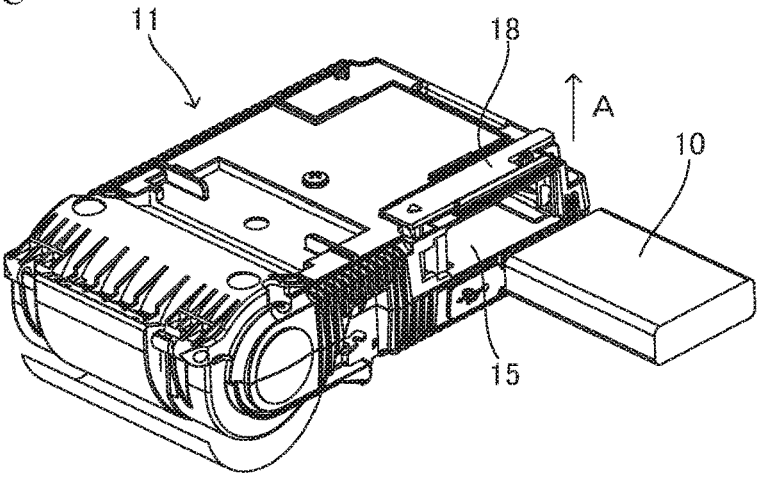
FIG. 2C is a perspective view of the another printer of FIG. 2B in an overturned state.

In the above-mentioned printer 1, in order to prevent the battery 7 from falling out of the housing 2, it is necessary to provide the battery lock 6 and the spring 8, and therefore the number of parts is increased. When the miniaturization of the printer 1 is required, there is a possibility that the battery lock 6 and the spring 8 cannot be mounted in the printer 1.

In the above-mentioned printer 11, in order to prevent the battery 10 from falling out of the housing 12, it is necessary to provide the holding member 18, and therefore the number of parts is increased. Moreover, when the battery 10 is attached and detached, the holding member 18 also must be removed from the housing 12 or attached to the housing 12, and therefore there is a problem that the operability of attachment and detachment of the battery 10 is poor.

A description will now be given of embodiments according to the present invention with reference to drawings.

Figure 3A:
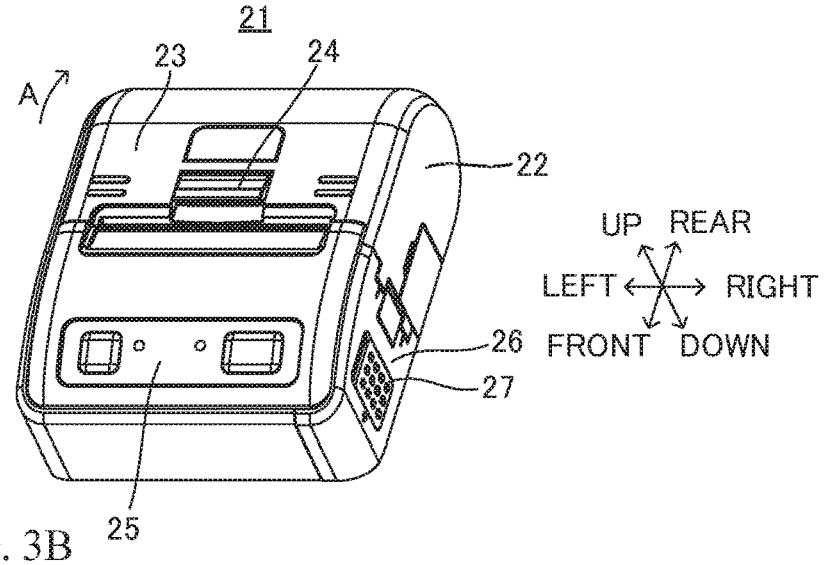
FIG. 3A is a perspective view of a printer according to a present embodiment.
Figure 3B:
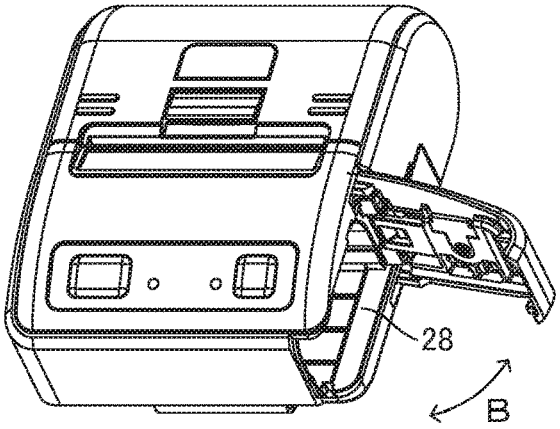
FIG. 3B is a perspective view of the printer when a battery cover is half-opened.
Figure 3C:
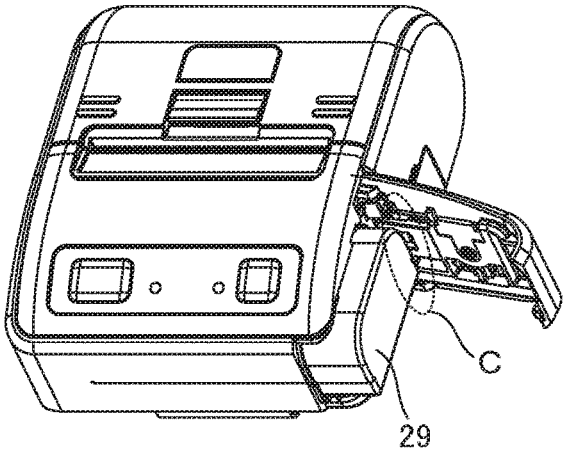
FIG. 3C is a diagram illustrating a state where a battery contacts the battery cover.

FIG. 3A is a perspective view of a printer according to a present embodiment. FIG. 3B is a perspective view of the printer when a battery cover is half-opened. FIG. 3C is a diagram illustrating a state where a battery contacts the battery cover. Hereinafter, a front and rear direction, a right and left direction, and an up and down direction are defined as illustrated in FIG. 3A, for convenience.

A printer 21 illustrated in FIG. 3A includes a housing 22, a cover 23, an open lever 24, an operation panel 25, a battery cover 26 and a lock lever 27. The cover 23 covers a rolled paper stored in the printer 21, is openably/closeably fixed to the housing 22, and can be opened in an A direction when the open lever 24 is depressed. The lock lever 27 is fixed to the battery cover 26 to be slid up and down. When the lock lever 27 is moved downward, the battery cover 26 can be opened as illustrated in FIG. 3B. When the lock lever 27 is moved upward, the battery cover 26 can be fixed to the housing 22 in a closed state. The battery cover 26 is opened and closed in a B direction as illustrated in FIG. 3B. When the battery cover 26 is opened, a storing part 28 for storing a battery 29 appears. When the battery cover 26 is half-opened, the battery 29 contacts the battery cover 26 as illustrated in a domain C of FIG. 3C, which makes it possible to prevent the battery 29 from falling out of the housing 22.

Figure 4A:
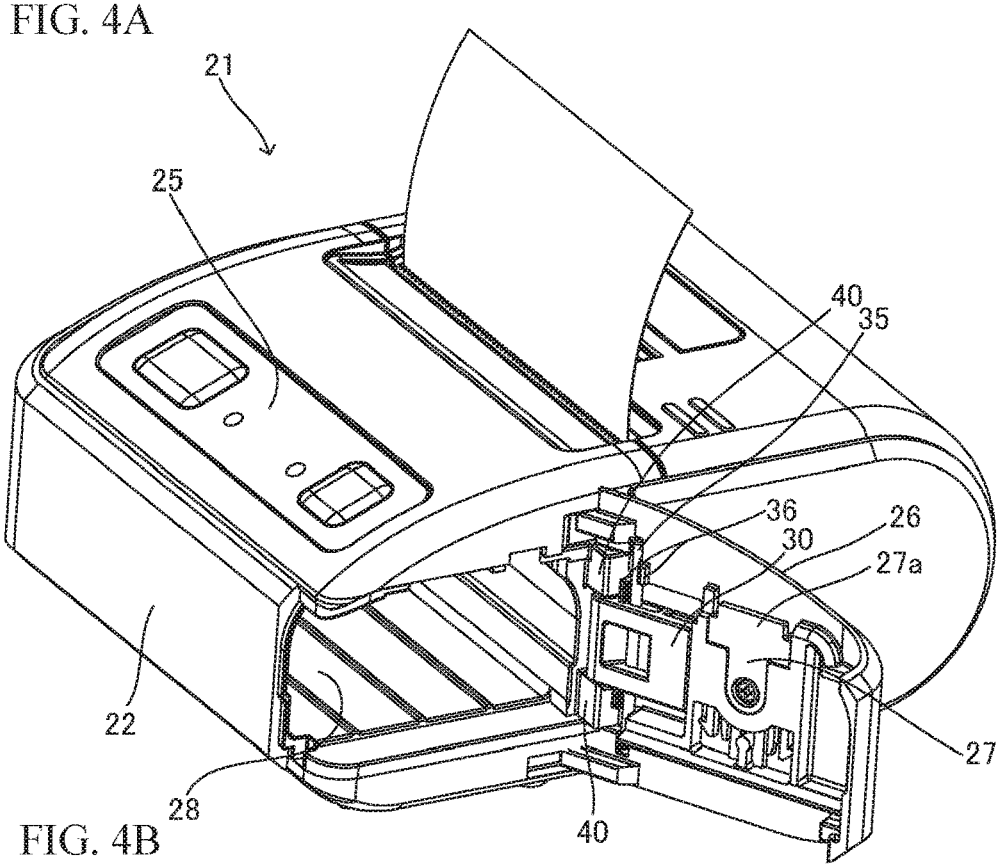
FIG. 4A is a perspective view of the printer when the battery cover is fully opened.
Figure 4B:
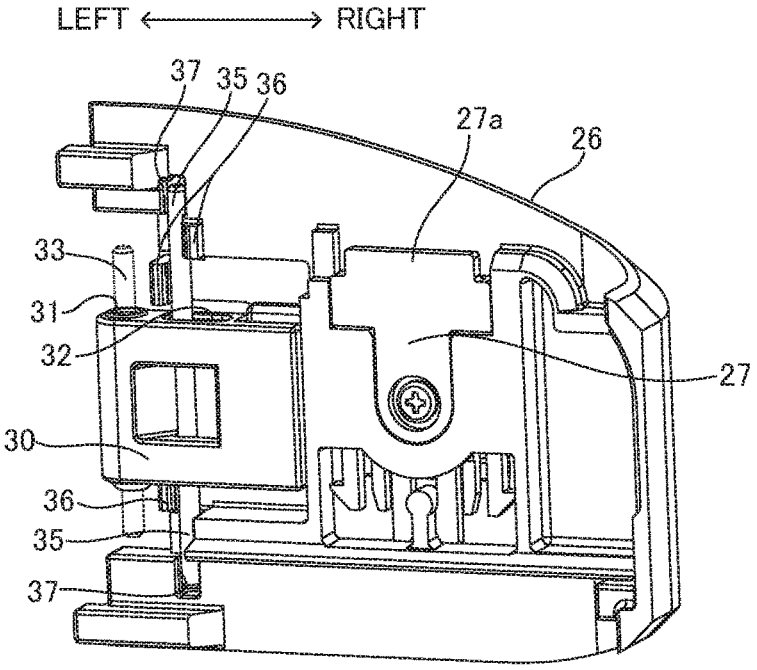
FIG. 4B is a configuration diagram of a back surface of the battery cover.

FIG. 4A is a perspective view of the printer 21 when the battery cover 26 is fully opened. FIG. 4B is a configuration diagram of a back surface of the battery cover 26.

A convex part 27*a* is formed on an upper end of the lock lever 27. When the battery cover 26 is closed and the lock lever 27 is moved upward, the convex part 27*a* engages with a part of a side surface of the housing 22 located above the storing part 28. Thereby, the battery cover 26 is fixed to the side surface of the housing 22.

Moreover, a groove 37 into which a shaft 35 is inserted and stoppers 36 fixing the shaft 35 are formed on the back surface of the battery cover 26.

Fixing parts 40 for rotatably fixing a rotating member 30 are fixed on the side surface of the housing 22 as illustrated in FIG. 4A. The rotating member 30 includes a through-hole 31 into which a shaft 33 is inserted, and a long through-hole 32 into which the shaft 35 is inserted and that movably supports the shaft 35 in the right and left direction of FIG. 4A. Both ends of the shaft 33 inserted into the through-hole 31 are fixed to the fixing parts 40. Thereby, the rotating member 30 is rotatably fixed to the fixing parts 40. Both ends of the shaft 35 inserted into the long through-hole 32 are fixed to the back surface of the battery cover 26 by the groove 37 and the stoppers 36. Since the shaft 35 is movable within the long through-hole 32 in the right and left direction, the battery cover 26 to which the shaft 35 is attached is fixed to the rotating member 30 to be movable in the right and left direction of FIG. 4B.

Figure 5A:
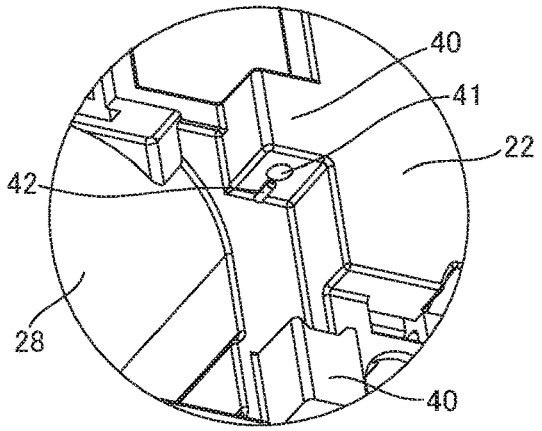
FIG. 5A is a configuration diagram of a fixing part.
Figure 5B:
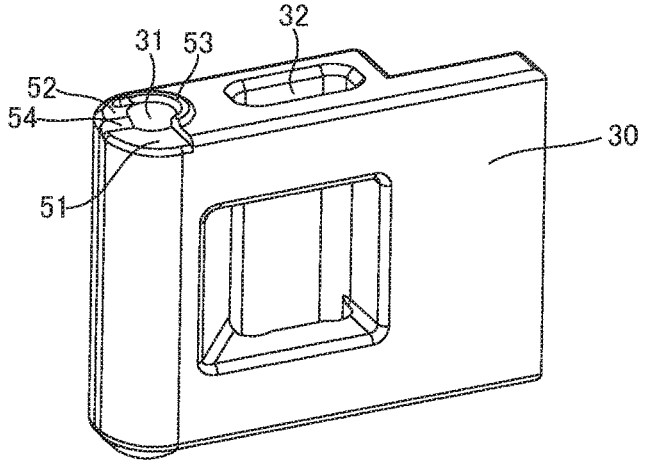
FIG. 5B is a configuration diagram of a rotating member.
Figure 5C:
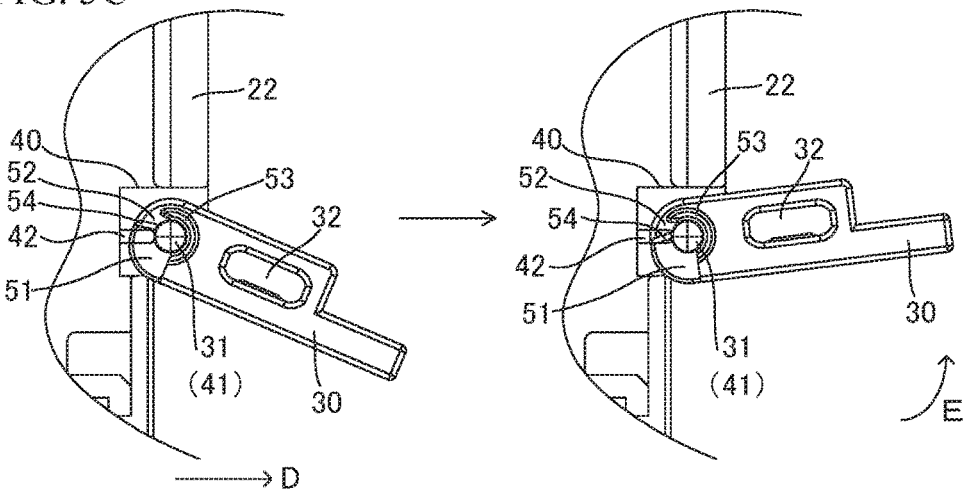
FIG. 5C is a schematic diagram illustrating an engagement state of the fixing part and the rotating member.

FIG. 5A is a configuration diagram of the fixing part 40. FIG. 5B is a configuration diagram of the rotating member 30. FIG. 5C is a schematic diagram illustrating an engagement state of the fixing part 40 and the rotating member 30.

A hole 41 into which the shaft 33 is inserted and a projection 42 that can contact the rotating member 30 are formed on a surface of the fixing part 40 opposite to the rotating member 30, as illustrated in FIG. 5A. In FIG. 5A, an upper fixing part 40 is provided with the hole 41 and the projection 42. A lower fixing part 40 also is provided with the hole 41. At least one of the upper fixing part 40 and the lower fixing part 40 may be provided with the projection 42.

Formed around the through-hole 31 of the rotating member 30 opposite to the fixing parts 40 are a recess 51 that does not contact the projection 42, a flat part 52 that allows the rotation of the rotating member 30 while contacting the projection 42, and a regulating part 53 that contacts the projection 42 and regulates the rotation of the rotating member 30, as illustrated in FIG. 5B. The recess 51 is dug from the flat part 52 and is formed at a position lower than the flat part 52. The regulating part 53 is formed to protrude vertically from the flat part 52. A coupling surface 54 between the recess 51 and the flat part 52 is inclined so that the projection 42 is easy to move from the recess 51 to the flat part 52.

When the projection 42 is located in the recess 51 as illustrated in a left drawing of FIG. 5C, the projection 42 does not contact the recess 51, and therefore the rotating member 30 rotates smoothly. At this time, the battery cover 26 is half-opened. When the projection 42 reaches the coupling surface 54, the opening operation of the rotating member 30 and the battery cover 26 is stopped once. Since the movement in a D direction (a pushing direction of the battery 29) of the battery 29 to be pushed by a battery terminal in the printer 21 is inhibited by the rotating member 30, it is possible to prevent the battery 29 from falling out of the housing 22.

When the projection 42 reaches the coupling surface 54 and further a user pushes the rotating member 30 or the battery cover 26 in a fully open direction E, the projection 42 enters the flat part 52 beyond the coupling surface 54 as illustrated in a right drawing of FIG. 5C. Although the projection 42 contacts the flat part 52, the rotating member 30 can rotate by a pushing force. When the projection 42 reaches one end of the regulating part 53, the rotation of the rotating member 30 is stopped. At this time, since the battery cover 26 is fully opened, it is possible to take out the battery 29.

Figure 6A:
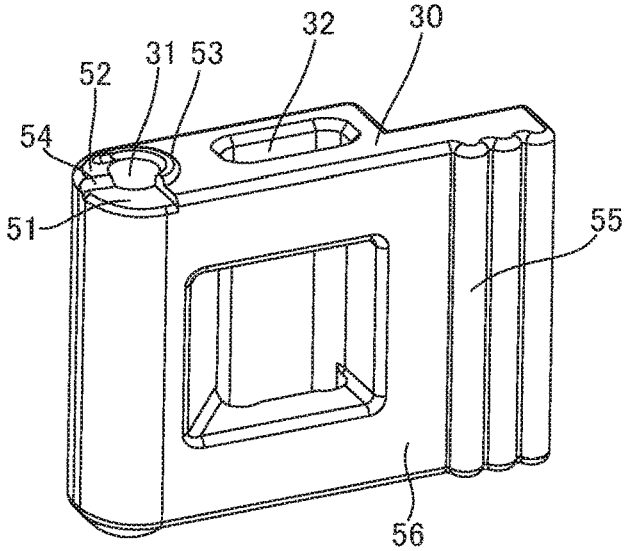
FIG. 6A is a diagram illustrating a first variation of the rotating member.
Figure 6B:
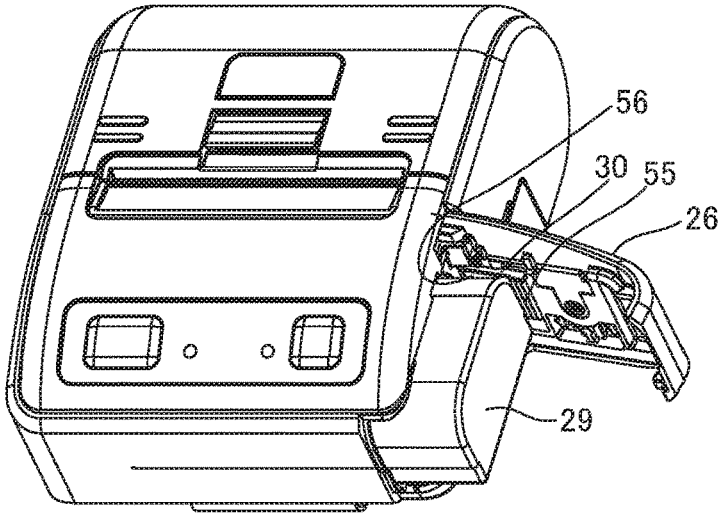
FIG. 6B is a perspective view of the printer to which the rotating member of the first variation is attached.
Figure 6C:
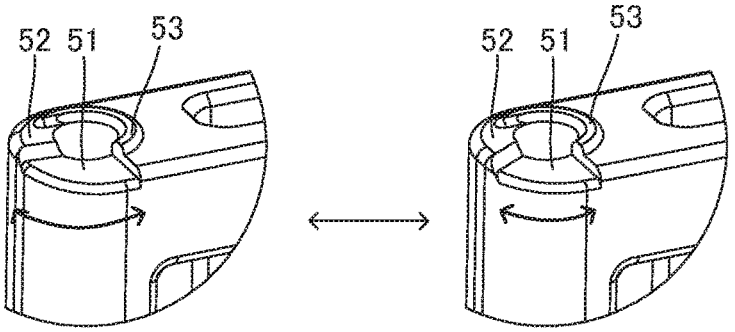
FIG. 6C is a diagram illustrating a variation of a recess of the rotating member.

FIG. 6A is a diagram illustrating a first variation of the rotating member 30. FIG. 6B is a perspective view of the printer 21 to which the rotating member 30 of the first variation is attached. FIG. 6C is a diagram illustrating a variation of the recess 51 of the rotating member 30.

A projection 55 for preventing the battery from falling out may be formed on a surface 56 of the rotating member 30 opposite to the battery 29 when the battery cover 26 is closed as illustrated in FIG. 6A. At this time, the projection 55 is formed at another end opposite to one end of the rotation member 30 on which the through-hole 31 is formed. The shape of the projection 55 is not limited to the shape illustrated in FIG. 6A. When the battery cover 26 is half-opened, the battery 29 contacts the projection 55 and it is therefore possible to prevent the battery 29 from falling out. Here, a recess or irregularity may be formed on the surface 56 of the rotating member 30 as a substitute for the projection 55.

In an example of FIG. 6A, the projection 55 is formed on the surface 56 of the rotating member 30. However, in order to increase friction between the battery 29 and the surface 56, a tape having a large frictional resistance may be pasted on the surface 56, or a surface treatment of irregularity may be performed on the surface 56.

Moreover, the position and the size of the recess 51 of the rotating member 30 may be changed as illustrated in FIG. 6C. In the right drawing of FIG. 6C, a width of the recess 51 is narrower than that of the recess 51 of the left drawing of FIG. 6C. Thus, by changing the position and the size of the recess 51, it is possible to adjust an opening angle of the battery cover 26 at the time of half opening of the battery cover 26.

Figure 7A:
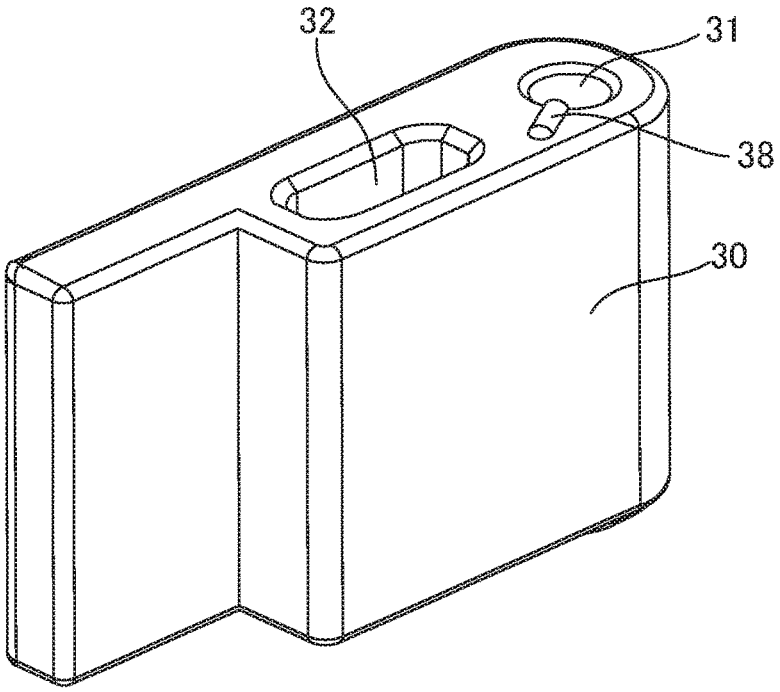
FIG. 7A is a diagram illustrating a second variation of the rotating member.
Figure 7B:
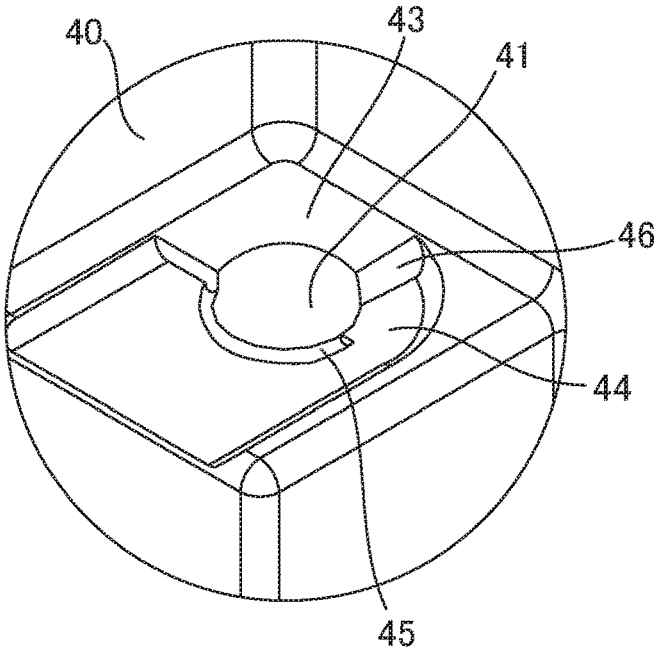
FIG. 7B is a diagram illustrating a first variation of the fixing part.

FIG. 7A is a diagram illustrating a second variation of the rotating member 30. FIG. 7B is a diagram illustrating a first variation of the fixing part 40.

In FIGS. 5A and 5B, the fixing part 40 includes the projection 42, and the rotating member 30 includes the recess 51, the flat part 52 and the regulating part 53. However, the rotating member 30 may include a projection 38, and the fixing part 40 may include a recess 43, a flat part 44 and a regulating part 45, as illustrated in FIGS. 7A and 7B.

The projection 38 that can contact the fixing part 40 is formed on an outer circumference part of the through-hole 31 and an upper surface of the rotating member 30, as illustrated in FIG. 7A. It is sufficient that at least one of the upper surface and the bottom surface of the rotating member 30 has the projection 38.

Formed around the hole 41 of the fixing parts 40 opposite to the rotating member 30 are the recess 43 that does not contact the projection 38, the flat part 44 that allows the rotation of the rotating member 30 while contacting the projection 38, and the regulating part 45 that contacts the projection 38 and regulates the rotation of the rotating member 30, as illustrated in FIG. 7B. The recess 43 is dug from the flat part 44 and is formed at a position higher than the flat part 44. The regulating part 45 is formed to protrude vertically from the flat part 44. A coupling surface 46 between the recess 43 and the flat part 44 is inclined so that the projection 38 is easy to move from the recess 43 to the flat part 44. FIG. 7B illustrates the configuration of the upper fixing part 40, but the lower fixing part 40 may include the recess 43, the flat part 44 and the regulating part 45.

When the projection 38 is located in the recess 43 and the projection 38 does not contact the recess 43, and therefore the rotating member 30 rotates smoothly. When the projection 38 reaches the coupling surface 46, the opening operation of the rotating member 30 and the battery cover 26 is stopped once. At this time, since the battery cover 26 is half-opened, it is possible to prevent the battery 29 from falling out. When the projection 38 reaches the coupling surface 46 and further the user pushes the rotating member 30 or the battery cover 26 in the fully open direction, the projection 38 enters the flat part 44 beyond the coupling surface 46. Although the projection 38 contacts the flat part 44, the rotating member 30 can rotate by the pushing force. When the projection 38 reaches one end of the regulating part 45, the rotation of the rotating member 30 is stopped. At this time, since the battery cover 26 is fully opened, it is possible to take out the battery 29.

Figure 8A:
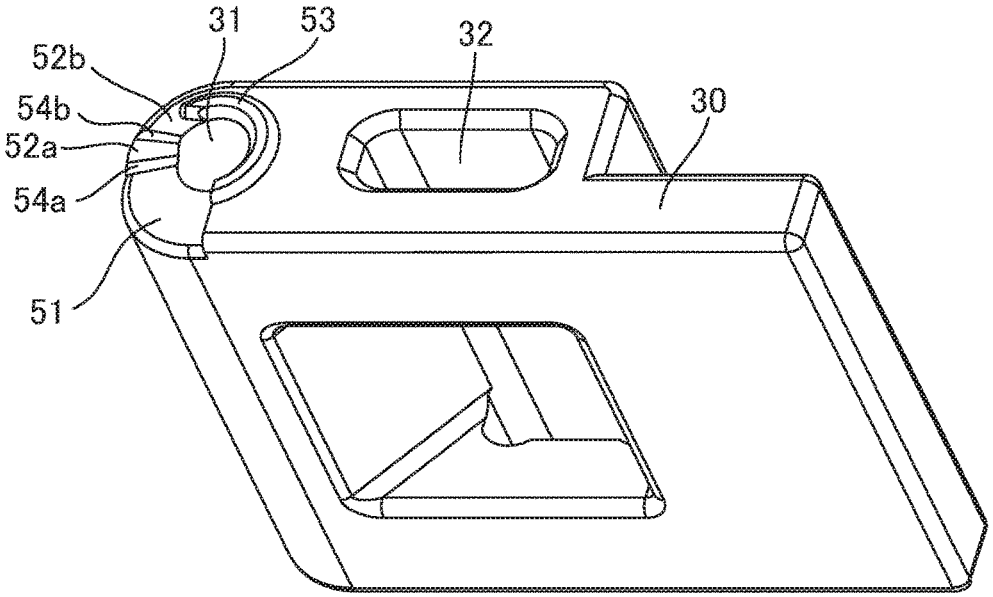
FIG. 8A is a diagram illustrating a third variation of the rotating member.
Figure 8B:
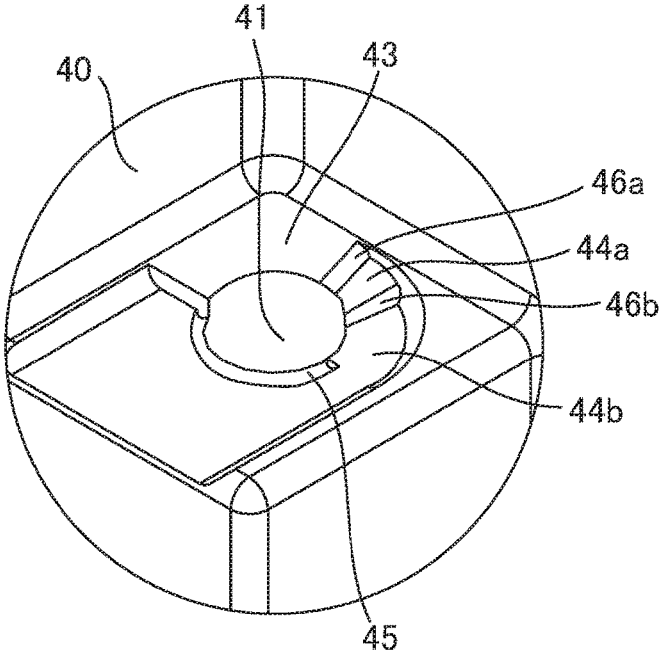
FIG. 8B is a diagram illustrating a second variation of the fixing part.

FIG. 8A is a diagram illustrating a third variation of the rotating member 30. FIG. 8B is a diagram illustrating a second variation of the fixing part 40.

Formed around the through-hole 31 of the rotating member 30 may be the recess 51 that does not contact the projection 42, a first flat part 52*a* that allows the rotation of the rotating member 30 while contacting the projection 42, a second flat part 52*b* that allows the rotation of the rotating member 30 while contacting the projection 42, and the regulating part 53 that contacts the projection 42 and regulates the rotation of the rotating member 30, as illustrated in FIG. 8A. The recess 51 is dug from the first flat part 52*a* and is formed at a position lower than the first flat part 52*a*. The first flat part 52*a* is dug from the second flat part 52*b* and is formed at a position lower than the second flat part 52*b*. The regulating part 53 is formed to protrude vertically from the second flat part 52*b*. A coupling surface 54*a* between the recess 51 and the first flat part 52*a* is inclined so that the projection 42 is easy to move from the recess 51 to the first flat part 52*a*. Moreover, a coupling surface 54*b* between the first flat part 52*a* and the second flat part 52*b* is inclined so that the projection 42 is easy to move from the first flat part 52*a* to the second flat part 52*b*. Thus, the rotating member 30 includes the plurality of flat parts 52*a* and 52*b* that allow the rotation of the rotating member 30 while contacting the projection 42, and thereby the opening angle of the battery cover 26 at the time of the half opening of the battery cover 26 may be adjusted.

Formed around the hole 41 of the fixing part 40 opposite to the rotating member 30 may be the recess 43 that does not contact the projection 38, a first flat part 44*a* that allows the rotation of the rotating member 30 while contacting the projection 38, a second flat part 44*b* that allows the rotation of the rotating member 30 while contacting the projection 38, and the regulating part 45 that contacts the projection 38 and regulates the rotation of the rotating member 30, as illustrated in FIG. 8B. The recess 43 is dug from the first flat part 44*a* and is formed at a position higher than the first flat part 44*a*. The first flat part 44*a* is dug from the second flat part 44*b* and is formed at a position higher than the second flat part 44*b*. The regulating part 45 is formed to protrude vertically from the second flat part 44*b*. A coupling surface 46*a* between the recess 43 and the first flat part 44*a* is inclined so that the projection 38 is easy to move from the recess 43 to the first flat part 44*a*. Moreover, a coupling surface 46*b* between the first flat part 44*a* and the second flat part 44*b* is inclined so that the projection 38 is easy to move from the first flat part 44*a* to the second flat part 44*b*. Thus, the fixing part 40 includes the plurality of flat parts 44*a* and 44*b* that allow the rotation of the rotating member 30 while contacting the projection 38, and thereby the opening angle of the battery cover 26 at the time of the half opening of the battery cover 26 may be adjusted.

As described above, in the present embodiment, the rotating member 30 that contributes to the opening and closing of the battery cover 26 contacts the projection 42 of the fixing part 40 and once stops the opening operation in a half-open state of the battery cover 26. Therefore, it is possible to prevent the falling of the battery 29 from falling out of the housing 22. Thereby, the printer 21 does not have to include a dedicated part to prevent the battery 29 from falling out.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. A printer comprising:

a housing having a storing part storing a battery of the printer;

a battery cover to open and close the storing part;

a rotating member that is rotatably fixed to the housing and is attached to the battery cover;

a fixing part that is formed on the housing, and rotatably supports a rotary shaft of the rotating member;

wherein the rotating member has a first plane and the fixing part has a second plane, the first plane and the second plane face each other, one of the first plane and the second plane has a first projection protruding towards the other of the first plane and the second plane, the other of the first plane and the second plane has a first surface that does not contact the first projection and a second surface that contacts the first projection along a rotating direction of the rotating member, and the battery cover, when opening the storing part, and when the first projection reaches the second surface from the first surface in following a rotation of the rotating member, blocks the battery from coming out of the storing part.

2. The printer as claimed in claim 1, wherein the rotating member includes one of a second projection, a recess or an irregularity that contacts the battery being pushed from the housing out of the storing part when the first projection reaches the second surface.

3. The printer as claimed in claim 1, wherein the second surface has a regulating part protruding towards the one of the first plane and the second plane and contacting the first projection moving on the second surface to regulate the rotation of the rotating member.

4. The printer as claimed in claim 1, wherein the second surface includes a coupling surface coupled to the first surface, and the coupling surface is inclined along the rotating direction.

5. A printer comprising:

a housing, a rotating member that is rotatably fixed to the housing, a fixing part that is formed on the housing, and rotatably supports a rotary shaft of the rotating member;

wherein the rotating member has a first plane and the fixing part has a second plane, the first plane and the second plane face each other, one of the first plane and the second plane has a projection protruding towards the other of the first plane and the second plane, the other of the first plane and the second plane has a recess, a flat part and a regulating part formed around the rotary shaft, the projection, in following a rotation of the rotating member, does not contact the recess when the projection moves across the recess, but contacts the flat part to enable the rotating member to rotate by a pushing force when the projection is positioned within the flat part, and the regulating part contacts the projection to regulate the rotation of the rotating member.

6. The printer as claimed in claim 5, further comprising:

a coupling surface that is formed between the recess and the flat part and inclined towards the flat part from the recess, wherein the rotating member stops rotating when the projection is received by the coupling surface.

* * * * *